United States Patent [19]

Wallace et al.

[11] 4,101,049

[45] Jul. 18, 1978

[54] SHIPPING TRAY FOR FRUIT

[75] Inventors: Harry S. Wallace, Largo, Fla.; Robert C. Taylor, Florence, Ky.

[73] Assignee: Hopple Plastics, Inc., Florence, Ky.

[21] Appl. No.: 776,216

[22] Filed: Mar. 10, 1977

[51] Int. Cl.[2] ..... B65D 81/16; B65D 81/24; B65D 81/26

[52] U.S. Cl. ..... 229/2.5 R; 206/507; 206/511; 217/26.5

[58] Field of Search ..... 229/2.5 R, 2.5 EC, 23 BT; 217/26, 26.5, 40, 42, 6 A; 206/557, 564, 507, 509, 511; D9/188, 243

[56] References Cited

U.S. PATENT DOCUMENTS

| | | | |
|---|---|---|---|
| 2,936,922 | 5/1960 | Williams | 217/26.5 |
| 2,939,602 | 6/1960 | Grant | 229/2.5 |
| 2,973,127 | 2/1961 | Royce | 229/6 A |
| 3,049,259 | 8/1962 | Mazzi et al. | 217/26.5 |
| 3,074,582 | 1/1963 | Martelli | 217/26.5 |
| 3,108,731 | 10/1963 | Royce | 217/42 |
| 3,157,345 | 11/1964 | George | 229/23 BT |
| 3,245,570 | 4/1966 | Friday | 217/26 |
| 3,451,577 | 6/1969 | Nuvick | 217/26.5 |

FOREIGN PATENT DOCUMENTS

| | | | |
|---|---|---|---|
| 124,061 | 5/1947 | Australia | 217/26 |
| 583,385 | 10/1958 | Italy | 217/26.5 |

*Primary Examiner*—William Price
*Assistant Examiner*—Allan N. Shoap
*Attorney, Agent, or Firm*—Wood, Herron & Evans

[57] ABSTRACT

A stackable, nestable shipping tray for fruit. The tray is formed from a single plastic sheet and has a plurality of pockets interspersed by posts which engage the underside of the pockets to support the trays when they are in stacked relation. Grooves and channels in the posts, holes in the pockets and recesses in a border flange around the sheets promote airflow around the fruit as well as drainage of moisture. The configuration of the trays and their relation to the container in which they are disposed for shipping provides maximum protection to the fruit.

4 Claims, 7 Drawing Figures

SHIPPING TRAY FOR FRUIT

This invention relates to a shipping tray for fruit, particularly grapefruit, and more particularly, the invention is directed to a tray which, when stacked with other identical trays in a container, maintains fruit disposed in pockets in the tray in good condition during shipping of the fruit over long distances and periods of time as, for example, in the shipping of the fruit from the United States to foreign countries.

Prior to the present invention, it has been the practice to export fruit in standard shipping containers. Such shipping containers have inside dimensions of approximately 17 × 10½ × 9½ inches into which the fruit is placed in more or less random fashion. These containers hold 4/5 of a bushel and contain 23 fruit, 27 fruit, or 32 fruit, depending upon the size of the fruit. The fruit are packed with an allowable ½ inch bulge in the containers and these containers are stacked one upon the other for shipment. The shipping time between the United States and Europe or between the United States and Japan, for example, may be from two weeks to more than five weeks. At the end of this period of time, the fruit will have suffered some damage for a number of reasons, such as pressure from the weight of the fruit, insufficient air circulating about the fruit and moisture remaining in contact with the fruit, the moisture coming from condensation as well as damaged fruit. Recent tests show that in excess of half of the fruit is damaged or deformed when shipped as described above, the damage being divided approximately equally between slightly damaged but still saleable fruit and seriously damaged fruit which is either thrown away or used for juice.

An objective of the present invention has been to provide a stackable shipping tray for use in a corrugated paperboard container and which is designed to keep the damage to the fruit to a minimum.

It is a further objective of the invention to provide a stackable shipping tray and container which cooperate to prevent deformation of the fruit; to improve airflow around the fruit; and to promote the drainage of moisture from around the fruit, hence maintaining the fruit in a healthier state.

These objectives are achieved in part by an improved shipping tray design, the shipping tray being formed from a single plastic sheet. The sheet has a plurality of very shallow pockets which are just deep enough to keep the fruit in place and which contain holes for moisture drainage and to some extent airflow. The tray further includes relatively tall posts interspersed around the pockets. The posts perform several functions:

First, the posts engage the underside of the pockets and support the trays in stacked relation when their orientation is reversed with respect to each other. In such stacked relation, contact of the fruit by a tray above the fruit is avoided.

Second, the posts are relatively thin to provide greater exposure to the flow of air about the fruit along with more complete exposure to biocidal gas to which the fruit are subjected when they are in their containers prior to shipment.

Third, the posts have relatively large vertical channels which increase the airflow capability of the trays. These channels further strengthen the posts thereby enabling the trays to be formed with less plastic material without substantial sacrifice in the strength of the tray.

Fourth, the posts are provided with grooves on the top of the posts as well as vertically down the sides of the posts to promote flow of moisture. These grooves cooperate with holes in the pockets thereby providing continuous although tortuous pathways for the flow of moisture from the topmost tray through the bottommost tray in a container.

Fifth, the tops of the posts are recessed so as to receive the curvilinear undersides of the pockets thereby providing a shallow overall pack and preventing lateral shifting of the stacked trays with respect to one another.

A further feature of the invention consists in providing beveled corners in a narrow flange forming the border of the tray as well as providing recesses at convenient locations along the length of the flange, all of which promote circulation of air within the container and throughout the fruit when the fruit-packed trays are stacked within the container. The recesses are to some extent aligned with the side channels in the posts referred to above for the purpose of promoting airflow.

A further feature of the invention is to provide a container and three different tray designs adapted to be packed in the same size container. Each tray design of the three employs the features referred to above. One tray design has eight pockets to accommodate 24 large fruit to a 4/5 bushel container, the medium-size tray contains nine pockets for packing 27 fruit to the 4/5 bushel container and the third tray has eleven pockets for packing 33 fruit to the 4/5 bushel container. The container further includes in its side walls two vertical slots which straddle the top and middle tray, respectively, so that each slot promotes airflow over the top and bottom of each tray which it straddles. A slot is also provided in each end wall of the container. The number of slots is held to a minimum in order to avoid weakening the overall container structure.

Thus, the trays of the present invention are adapted to pack the three major sizes of grapefruit utilizing a standard container. Regardless of the size of the fruit shipped, the container and tray combination provides minimum damage to the fruit. For example, recent tests have shown that fruit shipped in the tray and container combination of the present invention results in a 2.7% serious damage to the fruit (constituting a tenfold improvement over prior art standard mode of shipping) with slight damage (still saleable) amounting to 11.6%.

The several features and objectives of the present invention will become more readily apparent from the following detailed description of the invention taken in conjunction with the accompanying drawings in which.

Figure 1:
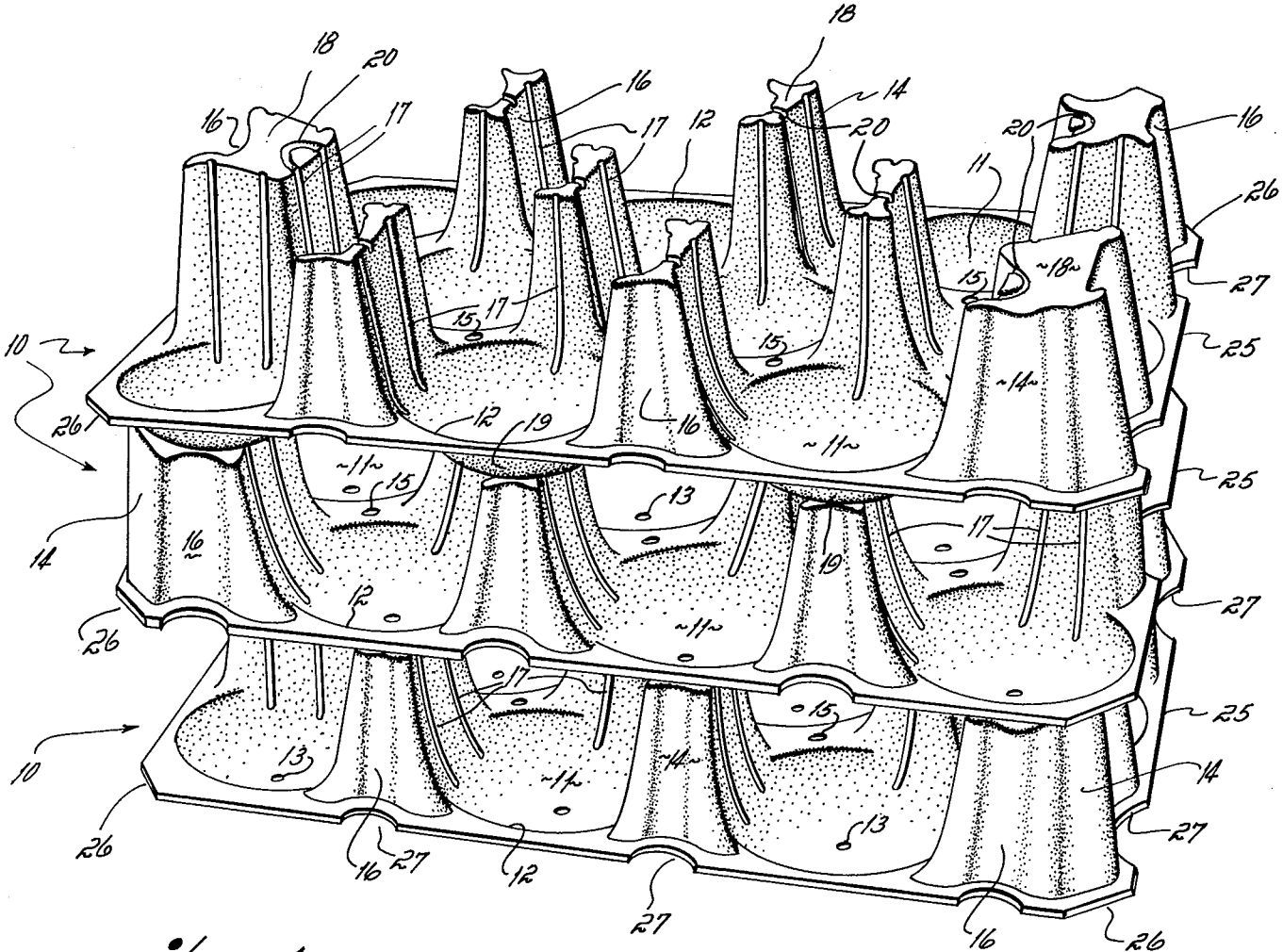
FIG. 1 is a perspective view of the tray of the present invention stacked three high.
Figure 3:
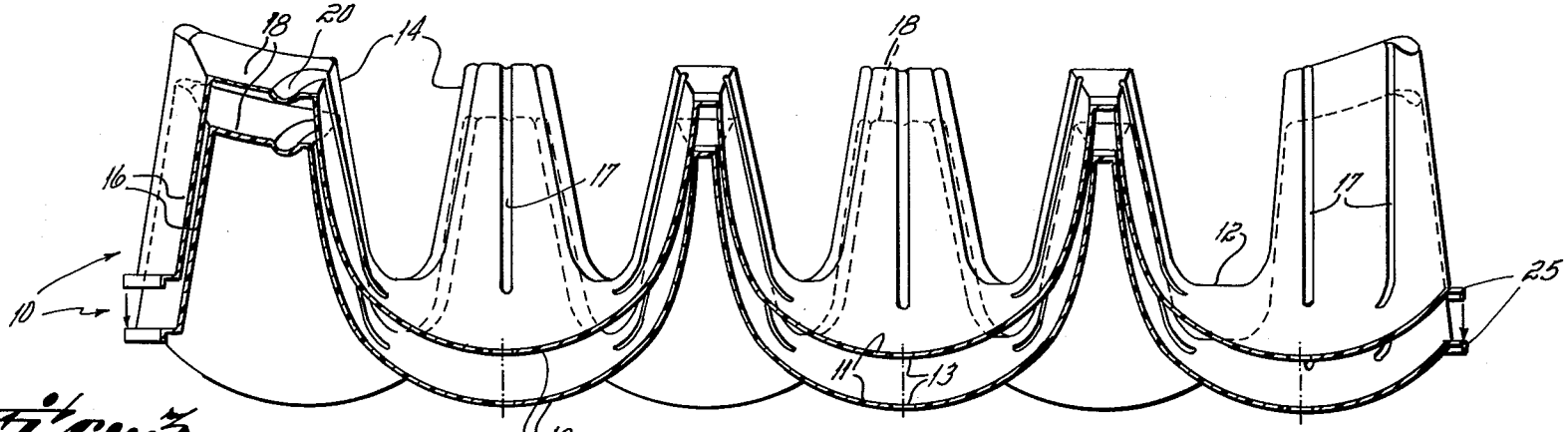
FIG. 3 is a cross-sectional view of two trays in nested relation.

Referring to FIG. 1, three trays each constructed in accordance with the present invention are shown in stacked relation as they would appear inside a shipping container which will be described below. The trays 10 are nestable as shown in FIG. 3, or, by reversing the orientation of the trays, are stackable as shown in FIG. 1. Each tray is formed from a single sheet of extruded high impact polystyrene which is vacuum formed. In each sheet a plurality of shallow pockets 11 are formed, each pocket being a small portion of a sphere and presenting upper edges 12 which collectively lie in a plane. The pockets are as shallow as possible consistent with holding the fruit in place so as to permit maximum exposure of the surface of each fruit to airflow. Each pocket has a hole 13 of approximately ¼ inch diameter through which moisture can flow and through which air to some extent will flow. Additional holes 15 may be formed in the tray to promote the flow of a biocidal gas to which containers of fruit are subjected.

Interspersed around the pockets are a plurality of tall posts 14 of somewhat irregular configuration. The overall height of the tray is 4 inches and the pocket depth is 1¼ inches so that the height of the posts is more than three times the depth of the pockets.

Each post has one or more vertical channels 16 extending the length of the posts. The channels function to strengthen the posts, thereby minimizing the amount of plastic material required to form the posts but without sacrifice to the overall strength of the tray. Each post also has one or more vertical grooves 17 extending from the top of the post downwardly to the top edge of each pocket. The grooves provide passageways for the flow of moisture from one tray to the tray below it and assist in the promotion of airflow around the fruit.

Each post has a top surface 18 which is somewhat recessed and located in a position to receive a curved under-surface 19 of each pocket so as to support each pocket when the trays are in stacked orientation. The recessed upper surfaces perform the dual functions of reducing the overall height of the stacked group of trays as well as maintaining the trays against lateral shifting with respect to one another when in stacked relation.

The upper surfaces 18 of the posts also have grooves 20 which underlie the holes 13 in the pockets when the trays are in stacked relation. The grooves 20 in the upper surfaces of the posts, cooperating with the holes 13 in the pockets, serve principally to promote moisture flow from an upper tray through the intermediate and lower tray to the bottom of a container and to a more limited extent promote air movement around the fruit.

Each tray has a peripheral or border flange 25 which lies in the plane of the upper edge 12 of the pockets 11 and which is engageable with the inside walls of the packing container. The corners of the flange 25 are beveled as at 26 to increase airflow and are recessed around the periphery of the tray as indicated at 27, again to promote airflow. For the most part, the recesses 27 are aligned with outwardly-facing channels 16 in the posts adjacent the recesses so that the cooperative effect of each recess 27 and associated channel 16 is to promote upward movement of air from one tray to the next.

Figure 5:
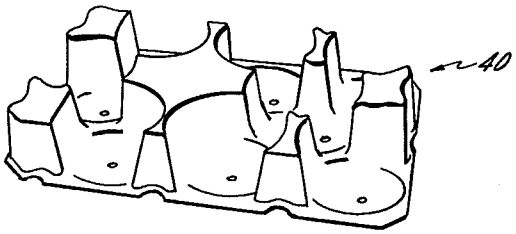
FIGS. 5 and 6 are perspective views of two alternative tray designs for differing sized fruit.

Each tray measures 17⅞ × 11⅞ inches. The trays are adapted to be stacked three high in a container 30 whose inside dimensions are 18 × 12 × 11¾ inches. It is to be understood that these dimensions are preferred for the shipping of grapefruit of three different sizes, but to the extent that the tray design might be employed for the shipping of different sizes of different fruit, the dimensions could be varied. It is an important aspect of the present invention however that the tray of FIGS. 1 and 2 as well as the trays of FIGS. 5 and 6 be the same size so that they can be shipped in the same 4/5 bushel container 30.

The container 30 has a deep bottom member 31 which cooperates with a telescoping top member 32, both members being formed from 350 lb. corrugated fiberboard. Each member 31 and 32 has in both side walls an upper, vertically elongated slot 35 and a lower, elongated vertical slot 36. The end walls each have a vertical slot 37. When the container is packed and the top member is telescoped over the bottom member, the slots 35 and 36 in the top member are aligned with their respective slots 35 and 36 in the bottom member to provide air holes for the introduction of air into the container. As can be seen with reference to FIG. 2, the upper slot 35 straddles the upper tray in the container, and the lower slot 36 straddles the middle tray in the container so that the relationship of the slots with respect to the tray permits air to flow above and below both upper and middle trays, thereby permitting air to circulate throughout the fruit in all three trays.

The tray just described has nine pockets 11 to accommodate size 27 grapefruit, that is, 27 grapefruit making up 4/5 bushel. Larger grapefruit would be packed in a tray 40 shown in FIG. 5. The tray 40 has eight pockets to accomodate 24 grapefruit to 4/5 bushel. The pocket, post and flange structure of the tray is substantially identical to that disclosed with regard to the tray of FIGS. 1 and 2 except for a different arrangement of the pockets and posts with respect to each other to accommodate the different number of pockets.

Figure 2:
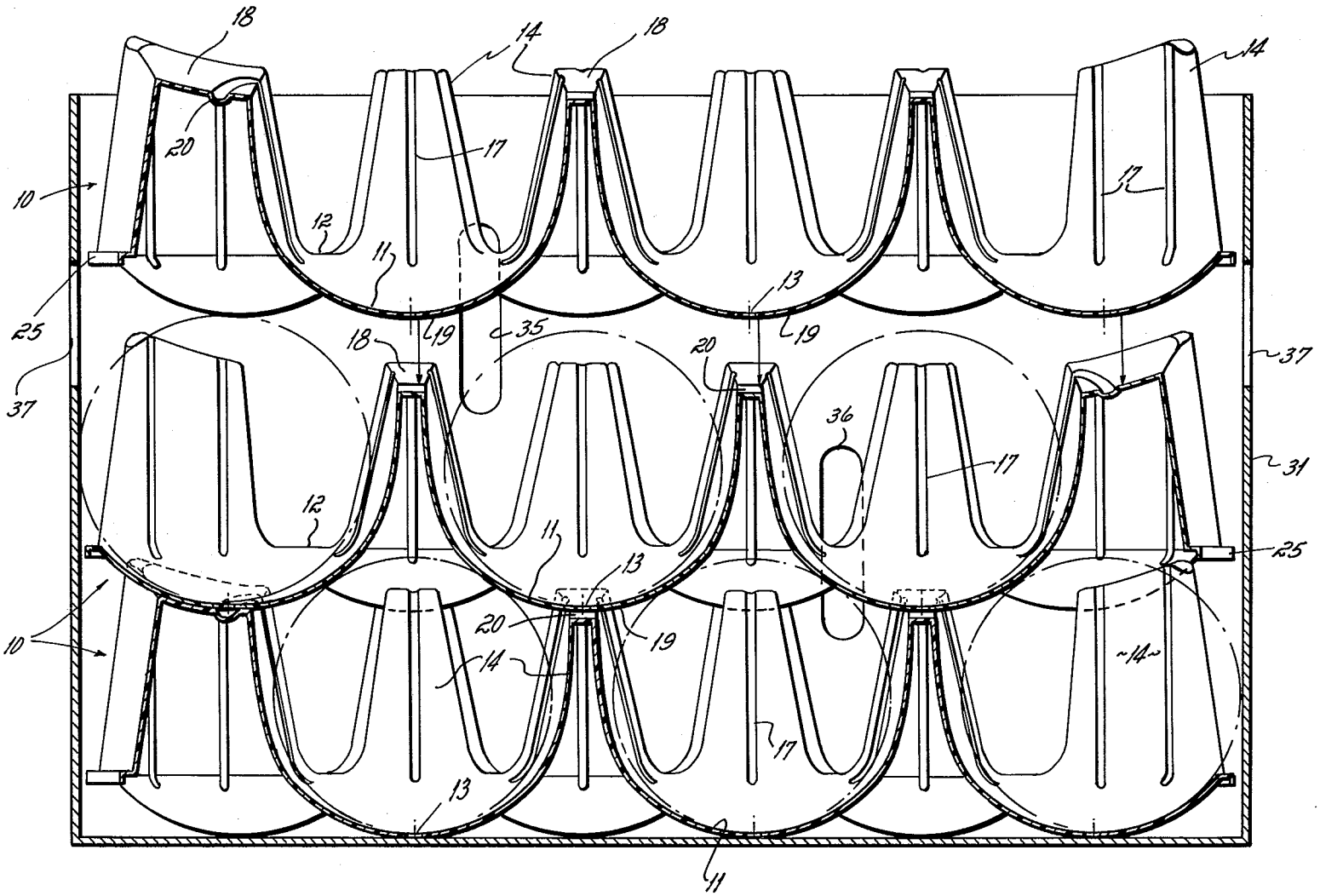
FIG. 2 is a cross-sectional view of a tray and container combination.
Figure 6:
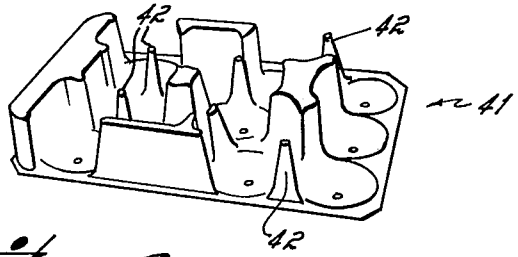
Figure 4:
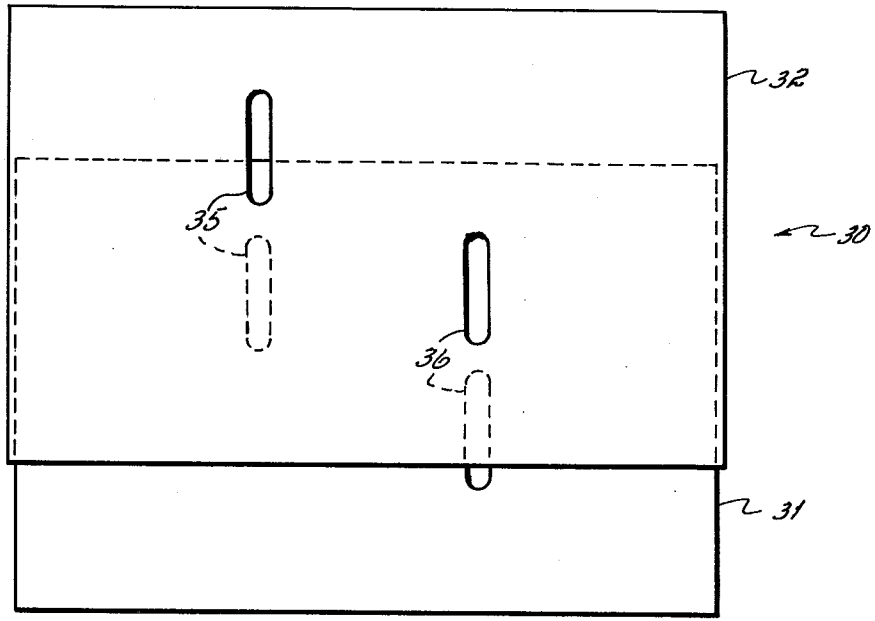
FIG. 4 is a side elevational view of the tray container.

Similarly, a tray 41 of FIG. 6 is designed for smaller grapefruit. In the tray 41, eleven pockets are provided to make up a 4/5 bushel with 33 fruit. Again, the features referred to in connection with the tray of FIGS. 1 and 2 are incorporated in the tray of FIG. 6 to promote strength, economy, airflow and moisture flow. Because of the greater number of pockets in the tray of FIG. 6, some of the posts 42 are quite thin, but they are nevertheless grooved and somewhat shallowly channeled for strength, moisture flow and airflow as described above.

Figure 7:
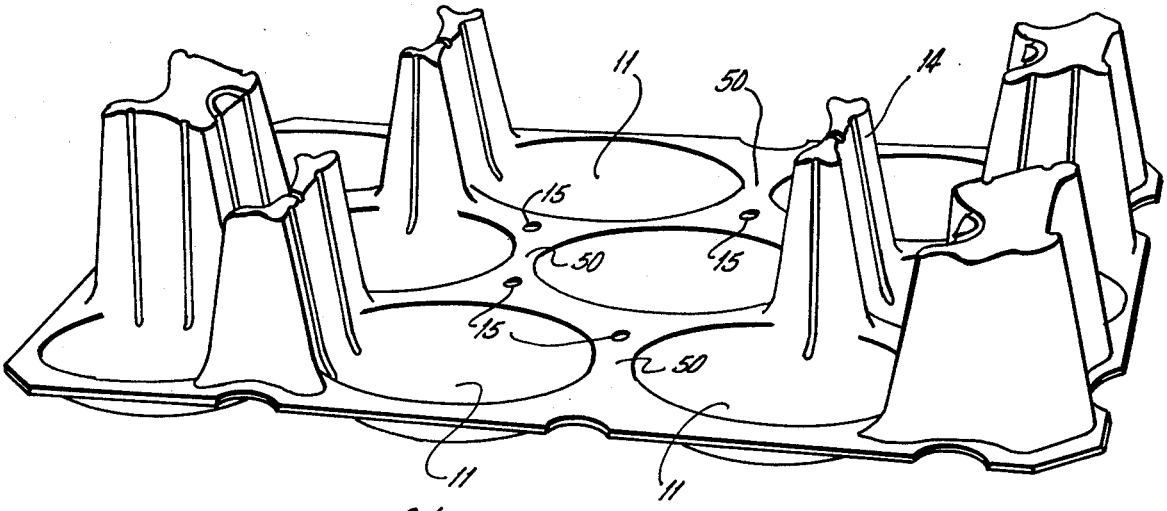
FIG. 7 is a perspective view of an alternative embodiment of the tray of FIG. 1.

The modification of the tray as exemplified by FIG. 7 effects a foreshortening of the longitudinal dimension of the tray so that the tray's overall dimension is 16⅜ × 11 7/16 inches. This shortening of the tray in turn permits a reduction of the dimension of the container in which three trays with their fruit are disposed, the new inside dimension of the container being 16½ × 11½ × 11¾ inches. While this modest reduction in dimension may not appear to be of great significance, when it is considered that 100,000 cases will be stacked for shipment, the overall cube space saved results in a considerable savings of money.

The reduction of the size of the tray and, hence, the container was effected by eliminating three of the center posts 14 and bringing the pockets 11, which had been spaced apart by those posts, substantially closer together as shown in FIG. 7. Thus, the spaces between those pockets, as indicated by the numbers 50, have a minimum dimension of about ½ inch.

As indicated above, that elimination of the posts and the moving of the pockets 11 closer together reduces the overall length of the tray and hence the container.

We claim:

1. A stackable, nestable shipping tray for fruit comprising, a single molded sheet having a generally planar peripheral border, a plurality of fruit-receiving pockets formed in said sheets, the upper edges of said pockets lying in a plane, a plurality of posts formed in said sheet and located adjacent said pockets, said posts projecting a uniform height above said plane a distance substantially greater than the depth of said pockets, said pockets having a depth which is less than one-third the overall height of a tray, said posts presenting generally vertical surfaces, said vertical surfaces having vertical grooves extending into said pockets, said pockets having holes in the bottom thereof, at least a portion of said pockets having an undersurface which is adapted to rest upon a respective post when a plurality of like trays, oppositely oriented, are in stacked relation, said posts having upper surfaces which receive the undersurfaces of said pockets, said surfaces having grooves therein to facilitate air and liquid flow, said posts, grooves and holes permitting air and liquid flow around the fruit between the top and bottom of a stacked group of filled trays.

2. A shipping tray as in claim 1 in which the upper surfaces of at least most of said posts are concave to receive the convex undersurface of each pocket thereby limiting side-to-side shifting of one tray with respect to the other when said trays are in stacked relation, and to reduce the overall height of a stacked group of trays.

3. A shipping tray as in claim 1 in which a portion of said pockets is located adjacent the periphery of said tray with an edge portion of each said peripheral pocket being immediately adjacent the edge of said tray.

4. A stackable, nestable shipping tray comprising, a single sheet of plastic, a plurality of shallow pockets formed in said sheet, the upper edges of said pockets lying in a plane, a plurality of posts formed in said sheet and projecting a uniform height above said plane, said pockets having a depth which is less than one-third the overall height of said tray, said posts having upper surfaces engageable with undersurfaces of said pockets to support said pockets when a plurality of like trays are oppositely oriented and are in stacked relation, said sheet having a thin generally planar border flange surrounding said pockets and posts, the corners of said flange being beveled and said flange adjacent said posts being recessed to provide improved air circulation throughout a group of stacked trays in a container, said posts having vertical channels to improve airflow and to provide strength to said posts, at least some of said channels being aligned with said flange recesses.

* * * * *